United States Patent [19]

Fleissner

[11] Patent Number: 4,805,425

[45] Date of Patent: Feb. 21, 1989

[54] DEWATERING DEVICE USING SUCTION REMOVAL OF LIQUID

[75] Inventor: Gerold Fleissner, Chur, Switzerland

[73] Assignee: Vepa Aktiengesellschaft, Basel, Switzerland

[21] Appl. No.: 123,274

[22] Filed: Nov. 20, 1987

[30] Foreign Application Priority Data

Nov. 20, 1986 [DE] Fed. Rep. of Germany ..... 8631105

[51] Int. Cl.[4] ..... D06B 15/04; D06B 21/02

[52] U.S. Cl. ..... 68/20; 68/62; 68/205 R

[58] Field of Search ..... 68/20, 22 R, 62, 181 R, 68/205 R

[56] References Cited

U.S. PATENT DOCUMENTS 3,608,340 9/1971 Fleissner ..... 68/20 X
3,681,950 8/1972 Fleissner ..... 68/22 R
3,700,404 10/1972 Janisch et al. ..... 68/22 R X
4,092,839 6/1978 Bahre et al. ..... 68/181 R X

FOREIGN PATENT DOCUMENTS 3033945 4/1982 Fed. Rep. of Germany .
3102408 9/1982 Fed. Rep. of Germany .

*Primary Examiner*—Philip R. Coe
*Attorney, Agent, or Firm*—Antonelli, Terry & Wands

[57] ABSTRACT

A dewatering device that effects suction removal of liquid from a length of fibrous material, such as textile material with several suction pipes or the like, each equipped with a suction slot and with wetting units connected upstream thereof. The suction pipes are arranged in series to treat the textile material and are located superimposed vertically in several tiers. For the zigzag-like guidance of the length of material, guide rolls are arranged one above the other in two rows aligned in a side-by-side relationship.

12 Claims, 1 Drawing Sheet

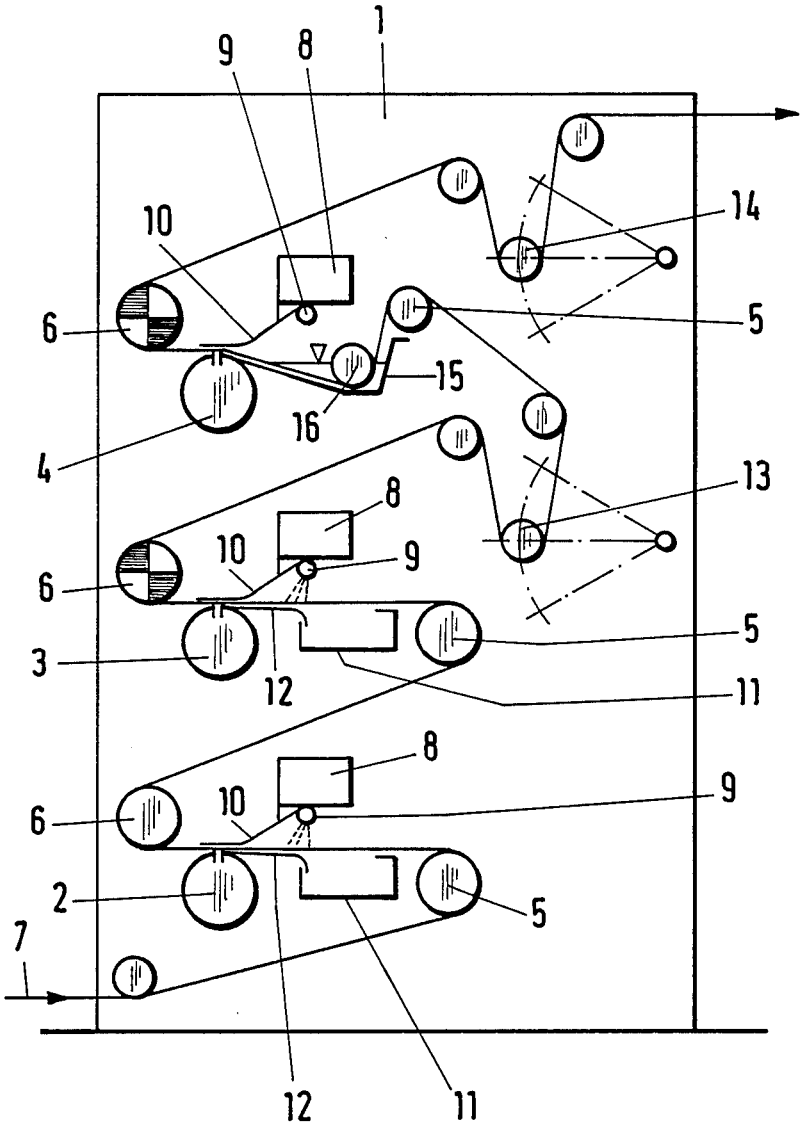
1
9
8
10
14
6
5
15
16
4
13
8
10
9
6
5
3
12
11
8
9
10
6
2
5
7
12
11

DEWATERING DEVICE USING SUCTION REMOVAL OF LIQUID

This invention relates to a dewatering device using suction removal of liquid from a length of fibrous material, such as textile material and in particular to a device having several suction pipes or the like, equipped with a suction slot, with wetting units connected upstream thereof that are arranged in series in the travel direction of the material for the treatment of the textile material.

A device of this type has been know from DOS No. 3,033,945. Furthermore, attention is drawn to DOS No. 3,102,408. The suction pipes are heretofore, in all instances arranged in horizontal side-by-side relationship, and the pipes are traversed in succession by the likewise horizontally guided textile material. This arrangement has been considered preferred because the vacuum acting through the suction slot is then enhanced by gravity. It has been found that in a washing machine of this type with several series-arranged suction pipes, the accessibility of all suction slots is very poor, especially in case of a relatively large working width. It happens time and again that a portion of the length of a suction slot is clogged by lint. However, in case of several suction slots arranged one behind the other, cleaning is then no longer readily possible.

Starting with the device of the type, the invention provides the construction of a device wherein the problem of poor accessibility of the suction units is avoided, and the device in total, with several suction units, is built on a small floor space.

In order to attain the thus-posed objective, the suction pipes are disposed in several tiers in superimposed vertical relationship and, for the zigzag-like guidance of the length of material, guide rolls are arranged superimposed in two rows aligned side-by-side. In this manner, the suction units can be located with preference vertically one above the other, and consequently every single suction slot is readily accessible from one long side of the washing device and thus can also be easily cleaned. Furthermore, in one embodiment of the device, the provision is made that, by an appropriate arrangement of the guide rolls, the length of material is always again guided in the horizontal direction, and the respective suction pipe is associated with the guide roll which then is the discharge guide roll. On account of this arrangement, the suction pipe is located in close proximity to the long side of the washing facility and thus is readily accessible. Suitably, a collecting trough is associated with the suction pipe on the underside of the length of material between a feeding guide roll and a discharging guide roll. This collecting trough will receive, in part, the washing water applied on top of the length of material by means of a spraying unit. However, in general, this collecting trough only collects the liquid that runs down along the lateral edges of the length of material, while the liquid sprayed onto the length of material is absorbed by the material and is then sucked through the length of material at the suction device and is removed.

The accompanying drawing shows by way of example a device according to the invention in a frontal view.

Three suction pipes 2, 3, 4 are arranged perpendicularly and vertically one above the other with a spacing in the washing facility 1. To the right and to the left of these suction pipes, guide rolls 5 and 6, respectively, are arranged in two rows aligned perpendicularly to the direction of the traveling length of material 7 side-by-side in such a way that the length of material 7 is in each case guided from the feed guide roll 5 to the discharge guide roll 6 in a horizontal direction. From the discharge guide roll 6, the length of material 7 then travels obliquely upwardly to the subsequent feed guide roll 5. Thereby, adequate space remains above the length of material passing horizontally between the associated pair of guide rolls 5 and 6 for the arrangement of a support 8 to which are mounted a spray pipe 9 and a cover flap 10, provided for the suction slot, over the operating width of the material. Underneath the length of material 7 between the respective guide rolls 5 and 6, a collecting trough 11 is in each case located in front of the respective suction pipes 2 to 4; this trough is tight, i.e. close with respect to the length of material 7 and is arranged to collect the overflowing liquid. From the collecting trough 11, a splash plate 12 extends in the direction toward the respective suction slot 2 to 4; this plate is also arranged initially in the close proximity to the length of material and then extends obliquely downwardly, so that the length of material which directly previously has absorbed the sprayed-on liquid is guided while being supported by this plate. Immediately subsequently, the thus-applied liquid is removed by suction at the suction pipe 2 to 4 at the bottom through the length of material. The suctioning-off slot is in each case covered above the length of material over the width of the slot by the cover flap 10 in order to enhance the suction effect.

The two upper discharge guide rolls 6 are driven and regulated with respect to their speed by the dancer rolls 13, 14. Furthermore, the uppermost collecting trough is simultaneously fashioned as an impregnating basin 15; for this purpose, a guide roll 16 supported at the level of the basin deflects the length of material 7 into the basin, filled up to its level with an impregnating fluid.

What is claimed is:

1. A device for treating a length of fibrous material, especially textile material, which comprises a plurality of suction pipes, each pipe equipped with a suction slot and arranged horizontally underneath a route of travel of the length of fibrous material, each pipe being associated with a respective unit arranged upstream thereof, said suction pipes and said wetting units being arranged in series to treat the textile material with a treatment liquid and to remove excess treatment liquid from the length of fibrous material by suction; said suction pipes being located superimposed one above the other in several tiers along one side of the device to promote accessibility to the suction slots and to facilitate cleaning of said suction slots, and guide means for providing a zigzag-like guidance of the textile material along said route of travel, said guide means including guide rolls arranged one above the other in at least two rows aligned in side-by-side relationship each row including a feed guide roll and a discharge guide roll; each of said suction pipes being associated with a discharge guide roll.

2. A device according to claim 1, wherein the suction pipes are arranged perpendicularly to the length of fibrous material vertically one above the other.

3. A device according to claim 1 or 2, wherein the guide rolls of the at least two rows are arranged perpendicularly to the length of fibrous material vertically one above the other.

4. A device according to claim 3, wherein by an appropriate arrangement of the guide rolls, the length of fibrous material is guided, in part, horizontally between the associated discharge guide roll and an associated feed guide roll.

5. A device according to claim 4, wherein the feed guide roll associated with a suction pipe in one tier is arranged level with and in parallel to said suction pipe and the discharge guide roll associated with said suction pipe in said one tier is arranged above and in parallel to said suction pipe.

6. A device according to claim 1, wherein between a feed guide roll and an discharge guide roll, a collecting trough is arranged on the underside of the travel route of the length of fibrous material, upstream of a suction pipe.

7. A device according to claim 6, wherein the collection trough is equipped with a drainage plate oriented obliquely with respect to the length of material in the upward direction, said drainage plate terminating directly in front of a suction slot of the suction pipe.

8. A device according to claim 7, wherein a spraying unit is associated with the drainage plate on the topside of the length of fibrous material and is arranged to spray liquid onto the length of fibrous material upstream of the suction slot.

9. A device according to claim 8, wherein the respective discharge guide rolls are operated at least in part as rolls that are driven in a regulated fashion.

10. A device according to claim 1, wherein accessibility to the suction slots is provided along an entire height of the device.

11. A device according to claim 1, wherein between a feed guide roll and an associated discharge guide roll, a collecting trough is arranged on the underside of the travel route of the length of the fibrous material upstream of a suction pipe; a reversing roller being provided in the collecting trough to submerge the length of fibrous material within a liquid contained within said collecting trough to effect impregnation of the length of fibrous material with said liquid.

12. A device according to claim 1, wherein at least one discharge guide roll deflects the length of fibrous material obliquely upward towards a feed guide roll associated with the superimposed suction pipe in the next tier.

* * * * *